US006570599B2

(12) United States Patent
Jacob et al.

(10) Patent No.: US 6,570,599 B2
(45) **Date of Patent: *May 27, 2003**

(54) PRODUCING GLOSSY IMAGES ON A MATTE LASER PRINTER

(75) Inventors: Steve A. Jacob, Boise, ID (US); Kurt R. Bengtson, Eagle, ID (US)

(73) Assignee: Hewlett-Packard Development Co., L.P., Houston, TX (US)

( * ) Notice: Subject to any disclaimer, the term of this patent is extended or adjusted under 35 U.S.C. 154(b) by 133 days.

This patent is subject to a terminal disclaimer.

(21) Appl. No.: 09/847,875

(22) Filed: May 2, 2001

(65) Prior Publication Data

US 2001/0017646 A1 Aug. 30, 2001

Related U.S. Application Data

(63) Continuation of application No. 09/298,983, filed on Apr. 22, 1999, now Pat. No. 6,271,870.

(51) Int. Cl.[7] ..... B41J 2/385
(52) U.S. Cl. ..... 347/156
(58) Field of Search ..... 347/156, 115, 347/119; 399/341, 320, 328, 335, 322, 400, 401, 68, 67, 194, 309

(56) References Cited

U.S. PATENT DOCUMENTS

| | | | | |
|---|---|---|---|---|
| 4,401,024 | A | 8/1983 | Frentress | 101/93.01 |
| 5,293,537 | A | 3/1994 | Carrish | 355/285 |
| 5,402,436 | A | 3/1995 | Paoli | 372/50 |
| 5,408,302 | A | 4/1995 | Manzer et al. | 355/285 |
| 5,424,163 | A | 6/1995 | Tokunaga et al. | 430/124 |
| 5,436,711 | A | 7/1995 | Hauser | 355/290 |
| 5,839,016 | A | 11/1998 | Folins et al. | 399/46 |
| 5,907,348 | A | 5/1999 | Ogasawara et al. | 347/212 |
| 5,987,270 | A | 11/1999 | Hulan et al. | 399/45 |
| 6,212,354 | B1 | 4/2001 | Garzolini et al. | 399/324 |
| 6,271,870 | B1 * | 8/2001 | Jacob et al. | 347/156 |

* cited by examiner

*Primary Examiner*—Shih-wen Hsieh
(74) *Attorney, Agent, or Firm*—Lane R. Simmons

(57) ABSTRACT

A matte laser printer produces a photographic like image on media by repeatedly fusing the toners deposited thereon. In a preferred embodiment, repeated fusing is accomplished by utilizing a duplexing path in the printer. In an alternate embodiment, a processing flow direction of the media is selectively reversed after fusing to enable multiple fusing operations. In either case, toner forming the image on the media is more fully fused, thereby reducing light scatter, such that a photographic like image is produced.

33 Claims, 3 Drawing Sheets

PRODUCING GLOSSY IMAGES ON A MATTE LASER PRINTER

CROSS REFERENCE TO RELATED APPLICATION(S)

This is a continuation of copending application Ser. No. 09/298,983 filed on Apr. 22, 1999, now U.S. Pat. No. 6,271,870 which is hereby incorporated by reference herein.

FIELD OF THE INVENTION

This invention relates in general to image forming devices and, more particularly, to producing a photographic image on a matte laser printer by fusing the image multiple times.

BACKGROUND OF THE INVENTION

Conventional color laser printers produce a generally low gloss, matte finish on printed sheet media. The matte finish is achieved by carefully controlling fusing temperature and fusing time so as to not over fuse the toner to the media. Fusing of toner to generate a matte finish typically leaves air pockets in the toner and a rough surface. The air pockets and rough surface cause light to be scattered when reflected back to the eye, thus presenting a matte finish or appearance. A more glossy finish is generated by further heating or fusing the toner to a point where the surface toner beads are better fused, thus the glossy finish, but the interior toner beads are generally not completely fused.

The process of properly fusing is complicated by factors such as differences in media type and whether or not duplexing is employed in the printer. For example, certain plastic media such as overhead transparencies or other heavy media require a hotter fusing temperature and/or a longer fusing time, compared to normal paper, in order to obtain an image that is sufficiently fused. However, fuser temperature is limited by the range of media supported by the printer. For example, any plastic media supported define a maximum fusing temperature because of their glass point or phase change point which causes warping. On the other hand, any heavy media supported define a minimum fusing temperature that is sufficient to actually fuse the toner to the media. Additionally, when a sheet is duplex imaged, it is a challenge to apply sufficient heat to fuse the second side to a proper appearance without over heating the first side.

When toners fuse completely, there are a minimal number of internal holes that remain to cause light scatter. This results in more light being reflected off of the media back through the toners to the eye. In the case of color toners (i.e., Cyan, Magenta and Yellow), more light means more color. In the case of black toner, less scatter means less light reflected back to the eye for a darker black. Overall, more color and darker blacks mean a more photographic look to images. However, fusing to obtain a photographic like image is also problematic. For example, merely increasing the fusing time or temperature is not always feasible because of the differences in toners, media types, or excess heat that exists during fusing of the second side of a duplex page. Disadvantageously, over fusing can cause media to curl, warp or jam the printer.

Accordingly, an object of the present invention is to provide a tool and method for enabling a photographic finish on sheet media in a matte laser printer.

SUMMARY OF THE INVENTION

According to principles of the present invention, a matte laser printer produces a photographic like image on media by repeatedly fusing the toners deposited thereon. In a preferred embodiment, this repeated fusing is accomplished by utilizing a duplexing path in the printer. In an alternate embodiment, a processing flow direction of the media is selectively reversed after fusing to enable multiple fusing operations. In either case, toner forming the image on the media is more fully fused, thereby reducing light scatter, such that a more photographic like image is produced.

Other objects, advantages, and capabilities of the present invention will become more apparent as the description proceeds.

DETAILED DESCRIPTION OF THE INVENTION

Figure 1:
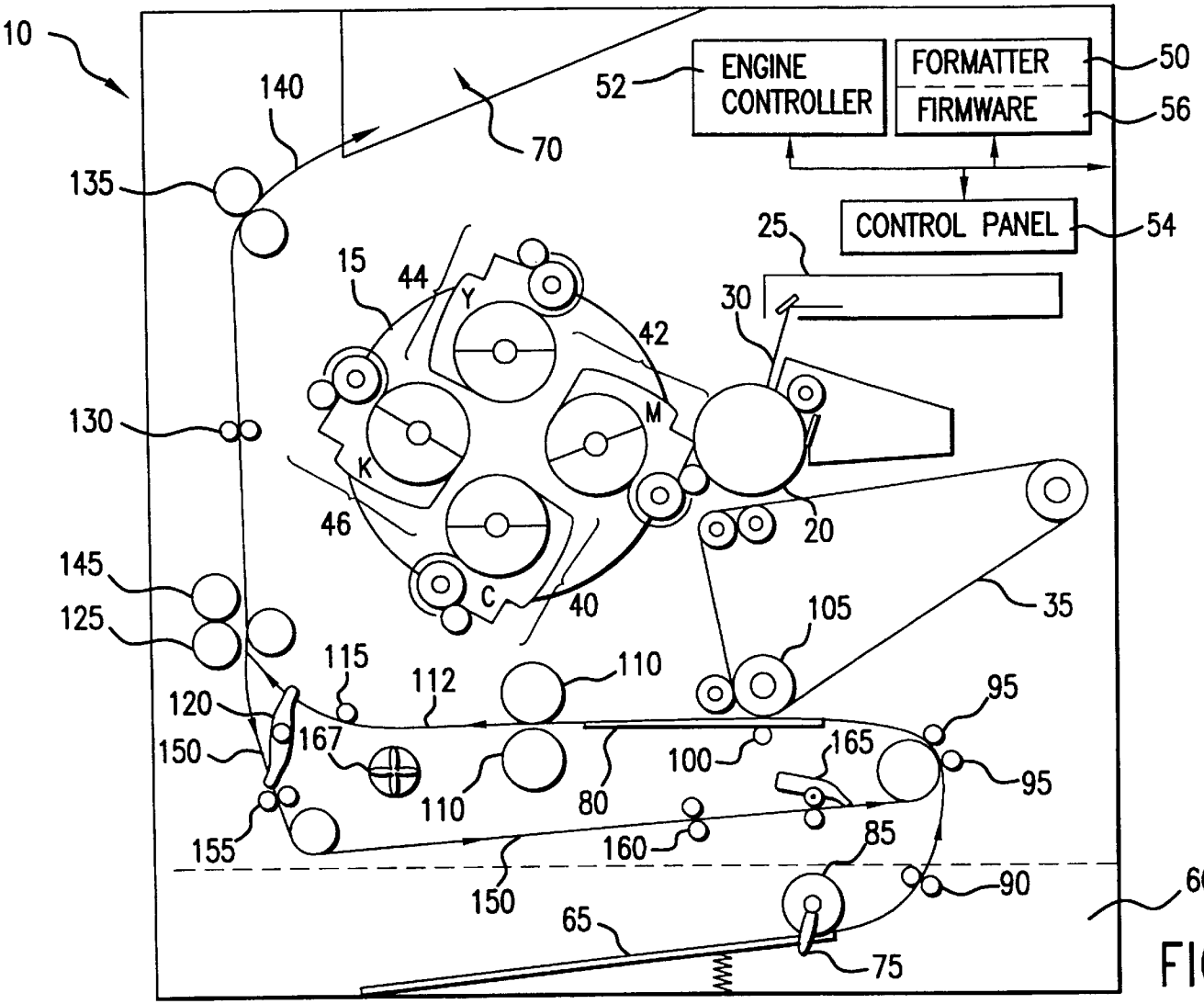
FIG. 1 is a cross sectional view in schematic diagram of a matte color laser printer employing principles of the present invention for enabling a photographic image.

FIG. 1 is a cross sectional view in schematic diagram of a printer 10 employing principles of the present invention. Although printer 10 is shown and discussed herein as a color laser printer having duplexing capabilities, it will be understood by those of ordinary skill in the art that the present invention is equally applicable to other electrophotographic (EP) image forming devices such as photocopiers, facsimile machines and the like, and to in-line EP devices, EP devices using an intermediate transfer drum or using no intermediate transfer mechanism, single or dual heated fusing roller configurations, and also to duplexing mechanisms, paths and configurations beyond that shown and described herein. Additionally, it is understood that fusing of an image on media occurs as the image is passed through the fuser roller or rollers regardless of: on which side of the media the image is disposed; whether one or both rollers are heated; and on which side of the media the heated roller is disposed (if there is only one heated roller) when fusing. Note, also, that the discussion of sheet media includes opaque and transparent paper sheets, plastic sheets such as overhead transparencies, vellum sheets, envelopes, cardstock and the like as is conventionally processed in a laser imaging device. Moreover, many conventional components are omitted from the drawing to maintain clarity with respect to the media processing paths for single sided and duplex printing as they relate to the present invention.

As conventional in the art, printer 10 is a matte business printer and includes developer carousel 15, photoconductive drum 20, laser optics 25, laser beam 30 for discharging drum 20, and intermediate transfer belt (ITB) 35. A cyan (C) developer 40, magenta (M) developer 42, yellow (Y) developer 44 and black (K) developer 46 are each mounted on developer carousel 15 in a respective developer station. Formatter 50 receives print data from a host system (not shown) and forms a raster print data stream. The raster print data stream is sent to engine controller 52 for conversion to a format suitable for controlling the pulsing of laser beam 30. Control panel 54 is disposed on an external surface of printer 10 and enables a user to directly interact with and control printer 10. Control panel 54 includes buttons, switches, or the like, and a display area such as a liquid crystal display (LCD). Firmware 56 stores data and routines to enable the operation of printer 10. Importantly, firmware 56 includes data and executable instructions for enabling a photographic like image on printer 10 under principles of the present invention.

Printer 10 further includes removable input tray 60 and biased bed 65 for holding sheet media to be processed through the printer. Output tray 70 receives the image processed media. Sensor 75 detects whether media is available on bed 65. Duplexing path 150 not only enables conventional duplexing but, importantly, further enables the present invention in a preferred embodiment as will be discussed herein.

Printer 10 forms a printed image onto sheet media 80 by first printing one of the four color planes CMYK onto photoconductive drum 20 and then immediately transferring that plane image to ITB 35. Once transferred, a next color plane is printed onto drum 20 and then also immediately transferred to ITB 35 over the previous color plane image. This process is repeated for each color plane required to form the image. Once all color planes are printed onto ITB 35, they are transferred to sheet media 80 to form a full color image thereon.

Now, under principles of the present invention, generally, printer 10 produces a photographic like image on sheet 80 by repeatedly fusing the toners deposited thereon to reduce light scatter, or until light scatter is minimized. In a preferred embodiment, sheet 80 is a white glossy media for enabling a most desirable overall photographic look. However, other media are feasible under the invention. Also in a preferred embodiment, this repeated fusing is accomplished by utilizing duplexing path 150 of printer 10. In an alternate embodiment, a processing flow direction of sheet media 80 is selectively reversed after fusing to enable multiple fusing operations.

To this regard, upon initiation of a single sided (non-duplex) print job, sheet 80 is picked from bed 65 by pick roller 85 and passed through transport rollers 90 and skew rollers 95 to transfer roller 100 and ITB 35 as supported by roller 105 for imaging of the sheet on a first side. Once the image is transferred to the first side, sheet 80 continues on through fuser rollers 110 where the toner is fused to the sheet. Subsequently, sheet 80 is passed along path 112 to transport rollers 115, sensor 120, and transport rollers 125. Once the trailing end of sheet 80 triggers sensor 120 near transport rollers 125, firmware 56 signals transport rollers 125 to retain the sheet and enable reversing mechanism 145. Consequently, reversing mechanism 145 reverses the direction of transport rollers 125 to draw the sheet down duplexing path 150. When the sheet is drawn down, it is guided to follow the duplexing path through transport rollers 155, 160, sensor 165, and then back up again through skew rollers 95 and transfer roller 100. Since no further imaging is to occur, sheet 80 simply passes through transfer roller 100 to arrive again at fuser 110. Importantly, sheet 80 passes again through fuser 110 for another fusing operation to further heat and fuse the toner on sheet 80 to reduce light scatter therefrom. This additional fusing and reduced scatter causes the image on sheet 80 to appear more photographic like.

Advantageously, the trip through duplexing path 150 has allowed sheet 80 to cool, thereby reducing the chance of sheet 80 becoming overheated and thereby avoiding potential curling, warping or jamming in printer 10 by the sheet. In contrast, if fuser 110 were merely heated extra hot, or if sheet 80 were slowed in its processing path as it passed through fuser 110, the potential for sheet 80 to curl, warp or jam printer 10 is increased.

This passing of sheet 80 through duplexing path 150 to enable additional fusing is repeated N number of times where N is indicative of as many times as is necessary to achieve a most desirable photographic appearance of an image on the sheet. Firmware 56 controls the number of iterations per design criteria of printer 10 including, for example, whether one or both fuser rollers 110 are heated, temperature setting of fuser rollers 110, rate of movement of the media, type of media used, chemical composition and formulation of each of the toners CMYK, and the like. Additionally, any incremental improvement in the resultant image on sheet 80 due to each iteration of fusing is balanced with the time cost of those iterations. In other words, at some point a reduced time to output tray 70 is preferable over any further visual improvement after N iterations of fusing. In any case, a preferred number of fusing iterations under the present invention clearly varies according to any one or more of these factors. However, at least two fusing operations are a minimum for a sheet 80 imaged on a single side. Additionally, an odd number of iterations is preferred if sheet 80 is to be ejected into output tray 70 with its image side down as occurs with conventional non-duplex imaging for printer 10.

After N fusing iterations, sheet 80 is again passed through transport rollers 115 and 125 but, now, reversing mechanism 145 is not engaged with transport rollers 125. Rather, sheet 80 continues to pass through transport rollers 130 and is finally ejected through output rollers 135 into output tray 70 as designated by path indicator 140.

On the other hand, upon initiation of a duplex print job, the same processing path 112, 150 just described for non-duplex printing is followed. However, the first time sheet 80 is passed through duplexing path 150, it is merely to satisfy the conventional duplexing operation for imaging the second side of sheet 80. To this regard, after a first side of sheet 80 is imaged and after the sheet is drawn down through duplexing path 150 to sensor 165, if data is ready for imaging on the second side of sheet 80, then the sheet is transported up and through skew rollers 95 and back to transfer roller 100 for imaging of the second side. The second side is now presented for imaging because of the inverting effect that occurred to the sheet due to it having been drawn down through duplexing path 150. Subsequently, the second side is fused 110.

At this point, sheet 80 is repeatedly passed through duplexing path 150 (as described with respect to the non-duplexing operation) for enabling N iterations of fusing and producing a photographic like image on both sides of sheet 80 before being passed up path 140 and ejected through output rollers 135 into tray 70. Notably, in this duplex imaging context, at least three fusing operations are a minimum for sheet 80. Additionally, an even number of iterations is preferred if sheet 80 is to be ejected into output bin 70 as occurs with conventional duplex imaging.

In an alternate embodiment, it is not necessary to employ duplexing path 150 to enable N fusing iterations. To this regard, a duplexing path 150 or capability is not even required for printer 10. Specifically, reversing mechanism 145 is coupled with transport rollers 125 and 115, and also with fuser rollers 110. In this context, after sheet 80 is imaged by transfer roller 100 and passed through fuser rollers 110 along path 112, firmware 56 signals reversing mechanism 145 to reverse the processing direction such that sheet 80 is drawn back in a "reverse" direction through fuser rollers 110 along the same path 112. Once sheet 80 is fused again, firmware 56 signals reversing mechanism 145 to again reverse the processing direction such that sheet 80 continues again in a "forward" direction through fuser rollers 110. Thus, this back and forth fusing of sheet 80 along path 112 is repeated N times or until a photographic like image is produced as previously discussed. Finally, when completed, sheet 80 is passed up path 140 and ejected through output rollers 135 into output tray 70.

Figure 2:
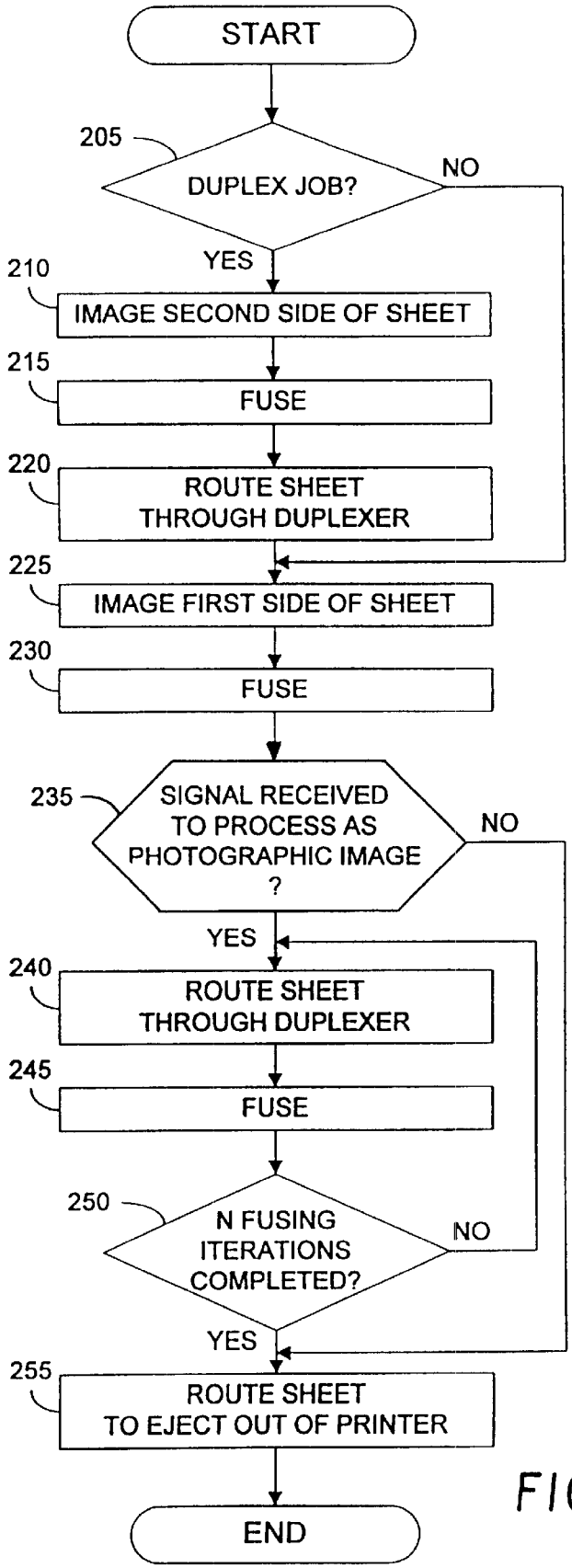
FIG. 2 is a flow chart depicting a preferred method of the present invention.

Referring now to FIG. 2, a flow chart depicts a preferred method of the present invention. In discussing FIG. 2, pertinent elements of FIG. 1 will also be referenced where appropriate. Preliminarily, if this is a duplex job to be processed 205, then a second side of a sheet 80 is imaged 210, minimally fused 215, and then routed 220 through duplexing path 150. Subsequently, a first side of the sheet is imaged 225 and fused 230. On the other hand, if this is not a duplex job 205, only the first side of sheet 80 is imaged 225 and then fused 230.

Next, if a signal has been received 235 to process this job as a photographic image under principles of the present invention, then sheet 80 is routed 240 through duplexing path 150 to be fused again 245. It should be noted here that the signal for controlling the photographic processing of the present invention is enabled in firmware 56 by, alternatively, an operation such as an input from control panel 54, a command received from a host computer (not shown), or a sensor (not shown) disposed in printer 10 that detects what type of media sheet 80 is (i.e., a sensor that detects whether sheet 80 is an overhead transparency, a heavy weight paper, or the like). In any case, whatever the source for enabling the signal to occur in firmware 56, the signal also dictates or includes the number (N) of fusing iterations for sheet 80 under the present invention.

Thus, after fusing 245, if N fusing iterations have not occurred 250, then sheet 80 is repeatedly routed 240 through duplexing path 150 and fused 245 until N fusing iterations are completed 250 such that a photographic like image is produced. Only then 255 is sheet 80 routed 140 to be ejected out of printer 10 into tray 70.

Figure 3:
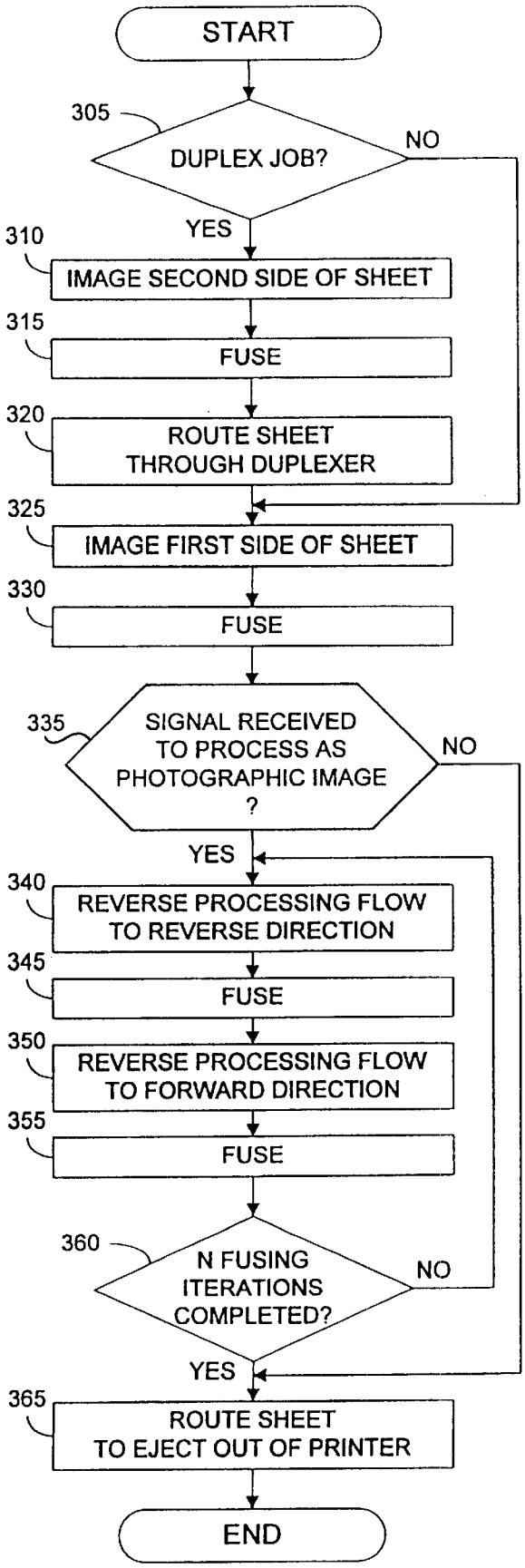
FIG. 3 is a flow chart depicting an alternate embodiment method of the present invention.

FIG. 3 depicts a flow chart of an alternate embodiment for repeatedly fusing an image according to principles of the present invention. Similar to FIG. 2, if this is a duplex job to be processed 305, then a second side of a sheet 80 is imaged 310, minimally fused 315, and then routed 320 through duplexing path 150. Subsequently, a first side of the sheet is imaged 325 and fused 330. On the other hand, if this is not a duplex job 305, only the first side of sheet 80 is imaged 325 and then fused 330.

Next, if a signal has been received 335 to process this job as a photographic image under principles of the present invention, then reversing mechanism 145 is activated to reverse the processing flow direction 340 such that sheet 80 is drawn back through fuser 110 in a "reverse" direction to be fused again 345. Subsequently, reversing mechanism 145 is again activated to again reverse the processing flow direction 350 such that sheet 80 is drawn back through fuser 110 now in a "forward" direction to be fused again 355.

Next, if N fusing iterations have not occurred 360, then sheet 80 is repeatedly reverse directionally processed 340, 345, 350, 355, back and forth through fuser 110 until N fusing iterations are completed 360 such that a photographic image is produced. Only then 365 is sheet 80 finally routed 140 to output tray 70.

It should be noted here that in this embodiment there is not, by default, as much delay time between fusing operations as occurs in the duplexing path 150 embodiment. Thus, a reduced time-to-print is achieved. However, on the other hand, sheet 80 and the imaged toner doesn't cool as much before the next fusing operation. As such, in yet a further embodiment, a delay time is inserted in firmware 56 for delaying the reversing of the processing direction 340, 350 before each next iterative fusing operation 345, 355 to allow for enhanced cooling of sheet 80. Alternatively, printer 10 is configured to include a cooling device, such as a fan 167 that blows air onto the fused media (relative to either processing direction), to further cool the media.

Finally, it will be obvious to one of ordinary skill in the art that the present invention is easily implemented utilizing any of a variety of components existing in the art. Moreover, while the present invention has been described by reference to specific embodiments, it will be apparent that other alternative embodiments and methods of implementation or modification may be employed without departing from the true spirit and scope of the invention.

What is claimed is:

1. A method of fusing in an imaging device, the method comprising:

(a) fusing at a single fusing element an image disposed on a sheet media for a non-duplex job a first time, the image being complete relative to all color planes to be developed for the image; and, (b) fusing the image at the single fusing element at least a second time to generate a more visually preferred fused condition of the image.

2. The method of claim 1 wherein the imaging device includes an electrophotographic imaging device.

3. The method of claim 1 further including passing the sheet media through a duplexing path in the imaging device after fusing the first time for fusing the at least a second time.

4. The method of claim 1 further including reversing a processing flow direction of the sheet media in the imaging device after fusing the first time for fusing the at least a second time.

5. The method of claim 1 further including enabling a cooling of the sheet media before fusing the at least a second time.

6. The method of claim 1 further including repeatedly reversing a processing flow direction of the sheet media in the imaging device after fusing the first time for fusing the at least a second time.

7. The method of claim 1 wherein the image includes toner disposed on the sheet media, and wherein fusing the at least a second time includes fusing multiple times until light scatter is minimized.

8. The method of claim 1 wherein the sheet media includes a glossy media.

9. A computer-readable medium having computer-executable instructions configured for performing steps including:

(a) fusing at a given fusing point an image disposed on a sheet media for a non-duplex job a first time, the image being complete relative to all color planes to be developed for the image; and, (b) fusing the image at the given fusing point at least a second time to generate a more visually preferred fused condition of the image.

10. A method of fusing in an imaging device, the method comprising:

(a) contact fusing at a fusing nip an image on a sheet media a first time;

(b) contact fusing the image at the fusing nip a second time; and, (c) contact fusing the image at the fusing nip at least a third time to generate a more visually preferred fused condition of the image.

11. The method of claim 10 wherein the imaging device includes an electrophotographic imaging device.

12. The method of claim 10 further including passing the sheet media through a duplexing path in the imaging device after fusing the first time for fusing the second time and after fusing the second time for fusing the at least a third time.

13. The method of claim 10 further including reversing a processing flow direction of the sheet media to a reverse direction in the imaging device after fusing the first time for fusing the second time, and reversing the processing flow direction to a forward direction after fusing the second time for fusing the at least a third time.

14. The method of claim 10 wherein the image includes toner disposed on the sheet media, and wherein fusing the at least a third time includes fusing multiple times until light scatter is minimized.

15. The method of claim 10 further including enabling a cooling of the sheet media before fusing the at least a second time.

16. The method of claim 10 wherein the sheet media includes a glossy media.

17. A computer-readable medium having computer-executable instructions configured for performing steps to enable:

(a) contact fusing of an image on a sheet media a first time at a single fusing point;

(b) contact fusing of the image a second time at the single fusing point; and, (c) contact fusing of the image at least a third time at the single fusing point to generate a more visually preferred fused condition of the image.

18. An electrophotographic imaging device, comprising:

(a) an imaging engine;

(b) a fuser; and, (c) a controller configured to present a sheet media to the fuser at least twice for a non-duplex job to be imaged to generate a more visually preferred fused condition of the image.

19. The imaging device of claim 18 wherein the means for presenting the sheet media to the fuser at least twice includes a duplexing path.

20. The imaging device of claim 18 wherein the means for presenting the sheet media to the fuser at least twice includes a reversing mechanism for reversing a processing flow direction of the sheet media in the imaging device.

21. The imaging device of claim 18 further including means for enabling a cooling of the sheet media before fusing the at least a second time.

22. The imaging device of claim 18 wherein the sheet media includes a glossy media.

23. An electrophotographic imaging device, comprising:

(a) an imaging engine;

(a) a fuser; and, (b) a controller configured to present a sheet media to the fuser at least thrice for a job to be imaged to generate a more visually preferred fused condition of the image.

24. The imaging device of claim 23 wherein the means for presenting a sheet media to the fuser at least thrice includes a duplexing path.

25. The imaging device of claim 23 wherein the means for presenting a sheet media to the fuser at least thrice includes a reversing mechanism for selectively reversing a processing flow direction of the sheet media in the imaging device.

26. The imaging device of claim 23 further including means for enabling a cooling of the sheet media before fusing a second time.

27. The imaging device of claim 23 wherein the sheet media includes a glossy media.

28. A method of fusing an image in an electrophotographic imaging device, the method comprising:

(a) fusing the image on a sheet media a first time at a fusing nip;

(b) fusing the image a second time at the fusing nip; and, (c) fusing the image at least a third time at the fusing nip to generate a more visually preferred fused condition of the image.

29. A method of processing in an imaging device, the method comprising fusing an image on a substrate N number of times by passing the substrate through a fuser N number of times, wherein (i) the image is not subject to any further color plane development, (ii) N is defined relative to establishing a preferred final image appearance on the substrate, and (iii) N is at least two.

30. A computer readable medium having computer-executable instructions configured to perform steps for enabling processing in an imaging device, the steps including enabling the fusing of an image on a substrate N number of times at a fusing element, wherein (i) the image is not subject to any further color plane development, (ii) N is defined relative to establishing a preferred final image appearance on the substrate, and (iii) N is at least two.

31. A method of imaging in an imaging device, the method comprising:

(a) detecting a user initiated signal indicative of a request to generate a glossy image for a print job for the imaging device; and, (b) responsive to the signal, fusing the image on a substrate N number of times at a single fusing source, wherein (i) the image is not subject to any further color plane development, (ii) N is defined relative to establishing a preferred final image appearance on the substrate, and (iii) N is at least two.

32. An imaging device, comprising:

(a) an imaging engine; and, (b) a controller in communication with the imaging engine, wherein the controller is configured to enable fusing of an image on a substrate N number of times by passing the substrate through a fuser N number of times, and wherein (i) the image is not subject to any further color plane development, (ii) N is defined relative to establishing a preferred final image appearance on the substrate, and (iii) N is at least two.

33. An imaging device, comprising a controller in communication with an imaging engine, wherein the controller is configured to:

(a) detect a user initiated signal indicative of a request to generate a glossy image for a print job for the imaging device, and, (b) responsive to the signal, fuse an image on a substrate N number of times at a given fusing element, wherein (i) the image is not subject to any further color plane development, (ii) N is defined relative to establishing a preferred final image appearance on the substrate, and (iii) N is at least two.

* * * * *